US005299610A

United States Patent [19]

Sentagnes et al.

[11] Patent Number: 5,299,610

[45] Date of Patent: Apr. 5, 1994

[54] PROCESS AND DEVICE FOR THE CONTINUOUS CHIPPING OF LONG TIMBERS

[75] Inventors: Dominique Sentagnes, Bordeaux; Rony Callens, Merignac, both of France; Karl Schaefer, Lechbruck am See, Fed. Rep. of Germany

[73] Assignee: Inter-Wood-Maschinen GmbH & Co. KG, Lechbruck am See, Fed. Rep. of Germany

[21] Appl. No.: 49,406

[22] Filed: Apr. 20, 1993

[30] Foreign Application Priority Data

Jul. 29, 1992 [DE] Fed. Rep. of Germany ..... 4224970

[51] Int. Cl.[5] ..... B27B 1/00

[52] U.S. Cl. ..... 144/370; 144/3 R; 144/162 R; 144/172; 144/181; 144/242 D; 144/242 M; 144/245 R; 144/246 R; 144/367; 144/180

[58] Field of Search ..... 144/1 R, 3 R, 39, 162 R, 144/172, 174, 176, 180, 181, 242 R, 242 D, 242 M, 245 R, 245 A, 246 R

[56] References Cited

U.S. PATENT DOCUMENTS

| | | | |
|---|---|---|---|
| 2,689,092 | 9/1954 | Clark et al. | 144/370 |
| 2,796,094 | 6/1957 | Himmelheber et al. | 144/180 |
| 3,209,801 | 10/1965 | Little et al. | 144/172 |
| 3,319,673 | 5/1967 | Voelskow | 144/172 |
| 3,866,645 | 2/1975 | Sybertz | 144/172 |
| 4,222,531 | 9/1980 | Thumm | 144/181 |
| 4,865,094 | 9/1989 | Stroud et al. | 144/370 |

FOREIGN PATENT DOCUMENTS

| | | | |
|---|---|---|---|
| 2130795 | 1/1973 | Fed. Rep. of Germany | 144/370 |
| 3018110 | 2/1982 | Fed. Rep. of Germany | 144/180 |

*Primary Examiner*—W. Donald Bray
*Attorney, Agent, or Firm*—Foley & Lardner

[57] ABSTRACT

A process and a device for the continuous chipping of timbers of different length. To increase the chipping performance, in the execution of the sawing cut or directly thereafter, at least one supporting element for supporting the leading end face of a long timber pack and the posterior end face of a short timber pack is directed into the sawing plane. Directly adjoining the short timber pack, a just sawn-off short timber pack, together with the supporting element enclosed between them, is conveyed forward by one advancement cycle in the same direction. The supporting element, following the conclusion of the advancement cycle, is conveyed back into the directing-in area of the sawing plane, and each short timber pack is supportingly transported, free from any structural distortion, up to the chipping tool.

18 Claims, 3 Drawing Sheets

PROCESS AND DEVICE FOR THE CONTINUOUS CHIPPING OF LONG TIMBERS

BACKGROUND OF THE INVENTION

The invention relates to a process for the continuous chipping of timbers of different length and shape, in particular of round timbers, which are piled essentially in longitudinal alignment one on top of the other and side by side in an at least approximately grain-parallel arrangement and are thus advanced in cycles. The timbers are compiled into a long timber pack of specific cross section, in the longitudinal direction, are cross-cut after each advancement cycle by a pack length corresponding to the advancement distance and corresponding, at the same time, to the usable chipping length to form, in each case, equal-length short timber packs. The timbers are subjected on both sides of the sawing plane to perpendicular compression forces, the short timber packs thus formed being conveyed forward in continuous succession transversely to their grain alignment, being therein supported, at least on their underside and the two end sides, and eventually being chipped parallel to the grain.

The invention further relates to a device for the continuous chipping of timbers of different length and shape, the device having a timber feed channel for receiving the timbers which are piled essentially in longitudinal alignment one on top of the other and side by side in an at least approximately grain-parallel arrangement and thus compiled into a long timber pack of specific cross section. The device includes advancement elements for the cyclical advancement of this long timber pack past a cut-off device; pressure mechanisms, disposed on both sides of the sawing plane and exerting perpendicular compression forces upon the long timber pack; and a chipping conveyor, the width of which corresponds to the length of the short timber pack or to the usable length of a chipping tool. The device supports the short timber packs, at least on their underside and their two end sides, and, transversely to their grain direction, feeds the chipping tool for grain-parallel chipping.

German Auslegeschrift 2 135 930 describes a process and a device for chipping waste timber of different length and diameter. According to this document, the pieces of timber are piled essentially in longitudinal alignment one on top of the other and side by side in an at least approximately grain-parallel arrangement and are thus compiled into a specific cross-sectional unit. The pieces of timber are next advanced in cycles in the longitudinal direction and, af ter each advancement cycle, cross-cut by a part-length corresponding to the distance of advancement. The sawn-off short timber pack is compressed, approximately vertically to its longitudinal alignment, into a block which, following the conclusion of the pressing operation, is fed to the chipping machine in continuous succession to the preceding short timber pack and transversely to its longitudinal alignment.

The previously known plant operates as follows: the pieces of timber of different length, thickness and shape, made up of waste timber, are laid side by side and one on top of the other into the timber supply channel, such that their cross section is essentially filled. The long timber pack which is thus formed is advanced in cycles and hence pushed past the cut-off device, which can be conf igured as a band saw, chain saw or circular saw, or even indeed as hydraulically-actuated shearing tools. In this case, there is sawn off from the advanced long timber pack a short timber pack, the length of which corresponds to the working length of a block chipper cutter connected downstream. In the cross-cutting procedure, the timber is already vre-compressed, by means of a prepress, in its spatial arrangement one to the other, and is secured during the cross-cutting procedure. This sawn-off short timber pack is then compressed, in a press chamber connected downstream of the cut-off device and aligned with the timber feed channel, by a press ram to the extent that a cohesive, compact block is produced from approximately grain-parallel waste pieces. This block is then pushed by means of a pushing ram into a chipper shaft and hence into the "effective" range of conveyor chains which circulate there. The block, due to its heavy precompression, is intended not to fall apart. In the chipper shaft, the block thus follows straight on from the preceding block, so that a compact column of timber is produced which, under the influence of a continuously operating chain advancement, is advanced constantly towards the cutter block of the chipper and is evenly chipped.

If, in the case of this previously known plant, the cut-off block is not to fall apart on its further transportation, very high compression forces must be applied. In this case, the specific weight of the timber is increased and its grain structure at least partially destroyed. For round timbers, a device of this type is therefore unsuitable.

In the case of the previously known plant, it is another disadvantage that, following the cutting operation, the block located in the press chamber first has to be pushed out of the press chamber bef ore a further advancement cycle of the long timber pack can be effected. The recovery of the kicker arm entails a corresponding time loss. It is a further disadvantage that, in the cyclical advancement of the long timber pack, small timber sections or butt end slices which are lying in front of the forward-traveling long timber are able to come to rest transversely or, indeed, tilt forward. The filling volume in the press chamber is thereby reduced. A plurality of residual pieces are ground more or less vertically to the grain instead of being chipped parallel to the grain, as a result of which the energy requirement and the share of unwanted fine material are considerably increased.

SUMMARY OF THE INVENTION

It is an object of the invention is to improve the previously known process and device in terms of chipping performance. It is endeavored, in this connection, to achieve in the chipping area a continuous timber advancement speed of 5300 mm per min., which is necessary in order to produce chips of timber thicknesses above 0.6 mm at high capacity.

This object of the invention is achieved by a process for the continuous chipping of timbers of different lengths and shapes, including the steps of piling the timbers in essentially longitudinal alignment one on top of the other and side by side in an at least approximately grain-parallel arrangement to form a long timber pack; advancing the long timber pack, in cycles, in the longitudinal direction; compressing the long timber pack with perpendicular compression forces on both sides of a sawing plane; cross-cutting after each advancement cycle by a pack length corresponding to an advancement distance and to a usable chipping length to form equal-length short timber packs; inserting at least one supporting element for supporting a leading end face of the long timber pack and a posterior end face of a just sawn-off short timber pack into the sawing plane; then conveying the long timber pack, together with the just sawn-off short timber pack and the supporting element enclosed between them, forward by one advancement cycle in the same direction; returning a second supporting element to an insertion area of the sawing plane; supporting the short timber packs, at least on their undersides and two end sides; conveying the short timber packs thus formed in continuous succession transversely to their grain alignment; and chipping the short timber packs parallel to the grain.

The object of the invention is further achieved by a device for the continuous chipping of timbers of different lengths and shapes, including a timber feed channel for receiving long timbers piled essentially in longitudinal alignment one on top of the other and side by side in an at least approximately grain-parallel arrangement and thereby compiled into a long timber pack; advancement elements for the cyclical advancement of the long timber pack; a cut-off device; pressure mechanisms disposed on both sides of a sawing plane for exerting perpendicular compression forces on the long timber pack; a chipping conveyor, a width of which corresponds to a length of a short timber pack or to a usable length of a chipping tool and which supports short timber packs, at least on their undersides and their two end sides, and, transversely to their grain direction, feeds a chipping tool for grain-parallel chipping; a short timber pack conveyor located upstream from the chipping conveyor and aligned with the timber feed channel and having a length of at least twice the short timber pack length; supporting plates for insertion between leading end faces of long timber packs and posterior end faces of adjoining short timber packs; and a return conveyor for taking up the supporting plates which have arrived at an end of the short timber pack conveyor and conveying them back into an area of the sawing plane.

Further objects, features, and advantages of the invention will become apparent from the following description taken in conjunction with the attached drawings.

BRIEF DESCRIPTION OF THE DRAWINGS

The drawings are hereby expressly made a part of the specification.

An embodiment of the invention, serving as an example, is diagrammatically represented in the drawings, in which.

DETAILED DESCRIPTION OF THE PREFERRED EMBODIMENTS

Figure 1:
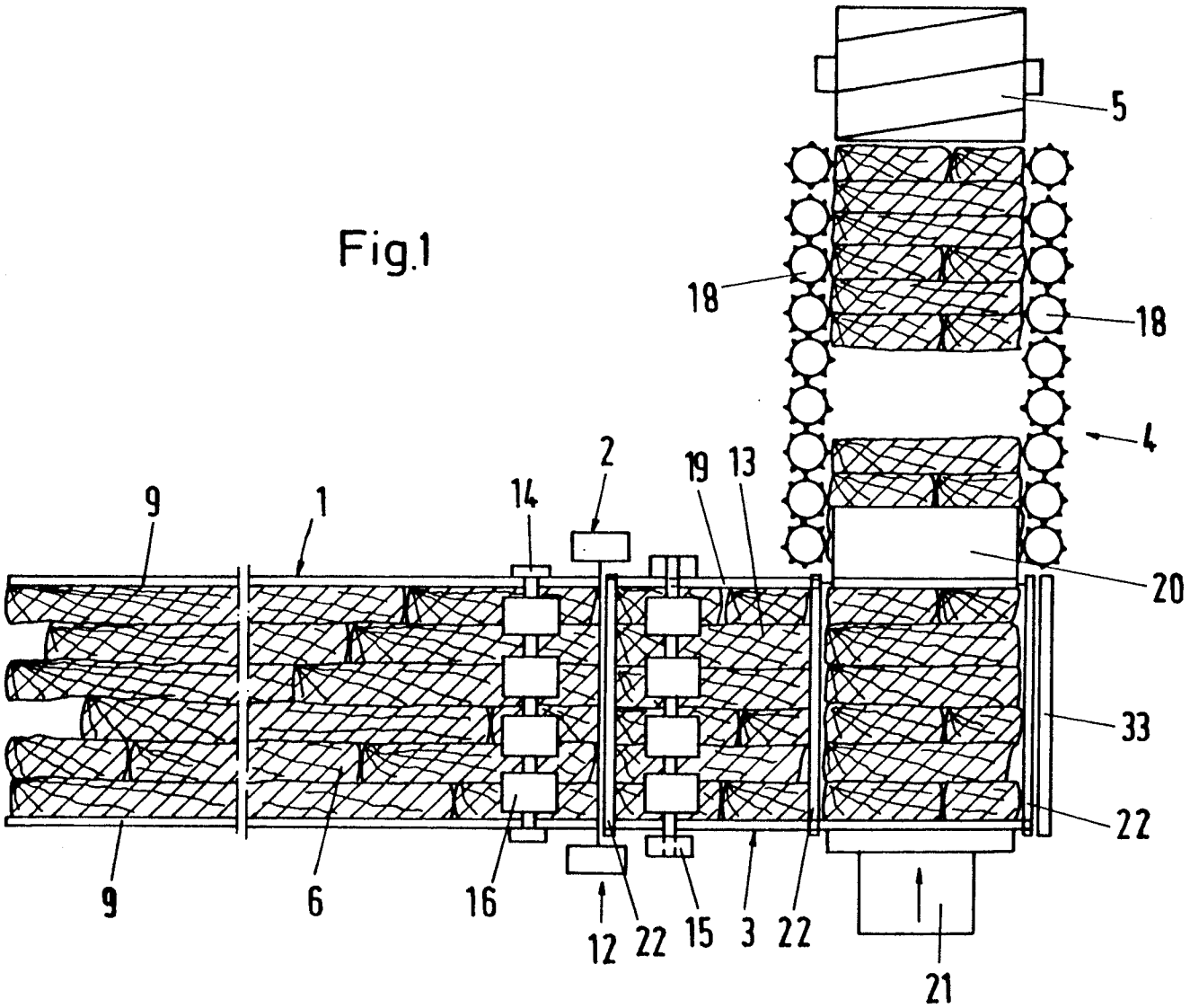
FIG. 1 shows a chipping plant in top view.

According to the invention, in respect of the process, in the execution of the sawing cut or directly thereafter, at least one supporting element for supporting the leading end face of the long timber pack and the posterior end face of the short timber pack is directed into the sawing plane, by the fact that directly thereafter the long timber pack, together with the just sawn-off short timber pack and the supporting element enclosed between them, is conveyed forward by one advancement cycle in the same direction, by the fact that the supporting element, following the conclusion of this advancement cycle or further advancement cycles, is conveyed back into the directing-in area of the sawing plane, and by the fact that each short timber pack is supportingly transported, free from any structural distortion, up to the chipping tool.

Upstream from the chipping conveyor there is connected a short timber pack conveyor, which is aligned with the timber feed channel and exhibits a length of at least twice the length of a short timber pack, by the fact that, upon each cyclical advancement of the long timber pack, between its leading end face and the posterior end face of the adjoining short timber pack there is provided a supporting plate and, for this, a return conveyor, which takes hold of the supporting plate which has arrived at the end of the short timber pack conveyor, conveys it back into the area of the sawing plane and there directs it back into the end side supporting position.

According to the invention, the residual pieces (butt end slices) which, due to the unsorted lengths, are inevitably produced in the long timber pack whenever a short timber pack is cross-cut, are thus prevented, upon the advancement of the long timber pack, from tilting forward and from giving rise to the disadvantages described above.

Because, according to the invention, the sawn-off short timber pack is conveyed onward at least once more, by one advancement cycle, in the longitudinal direction of the timber feed channel, the particular removal of a short timber pack onto the chipping conveyor can be carried out during the sawing operation; moreover, the short timber pack which has just been sawn off can always be conveyed forward, simultaneously with the long timber pack, by one advancement cycle.

According to the invention, the cut-off device can be a saw which cuts from the bottom upwards. In this case, it is expedient if the cut-off device, when configured as a chain saw, is provided with a wide cutter bar which constitutes a provisional end wall support. That is to say, the operation is conducted with only one saw, which—as soon as it travels back into its home position—is directly tracked by a partition which then, together with the timber pack, is horizontally displaced. If the saw is disposed below the timber pile, then a partition, together with the returning saw, would track the saw from top to bottom at a short distance apart. The relatively wide sawing cut which this necessitates can readily be tolerated, especially because the chip shape can be influenced by the configuration of the saw teeth or sawing elements such that usable utility material is produced for board production. A disadvantage with this concept, however, is the relatively long sawing time when only one saw is used. It can further be disadvantageous that the risk of jamming between timber and saw becomes greater as the depth of cut increases. Normal chain saws have not theref ore proved themselves in this connection.

In an alternative solution, the cut-off device could also comprise a saw cutting from top to bottom and a saw cutting from the bottom upwards. In this case, the upper saw would saw through the timber pack to only around midway through the pile height, cutting from top to bottom. Then the lower saw cuts from the bottom upwards likewise to midway through the pile height. Shortly before the lower saw has reached its end position, the upper saw is returned into its home position to enable the lower saw then, in rapid advancement operation, to travel through to the top edge of the timber pack in order to free the saw gap from any smaller pieces of timber which might have penetrated. Next, both saws can then travel without contact towards one another in a mid-position in which they form a provisional partition between the now anterior end side of the long timber pack and the posterior end side of the short timber pack which has just been sawn off.

Finally, according to the invention, each short timber pack is constantly supported on its two end sides, up to the chipping tool, by the cut-off device, so that, in conjunction with the other supports for the short timber pack, the transportation of the short timber pack is effected supportingly and, therefore, free from structural distortion.

With the solution according to the invention, the possibility is created for the first time, given a timber feed channel width of 1500 mm, of sawing off a short timber pack approximately every 17 seconds and of feeding the chipping tool at an advancement speed of 5300 mm/min. This results in a substantial increase in chipping capacity.

A plant for the continuous chipping of long timbers, in particular round timber, is provided. As shown in FIG. 1, the essential components of the plant are a timber feed channel 1, a cut-off device 2 limiting the timber feed channel on the front side, a short timber pack conveyor 3 aligned with the timber feed channel 1, a chipping conveyor 4 adjoining the short timber pack conveyor at right angles and a chipping tool 5 closing off the chipping conveyor on the front side, which chipping tool is represented in the illustrative embodiment as a cutter-block, but could also be a disk chipper.

The timber feed channel 1 serves to receive the timbers 6 which are piled essentially in longitudinal alignment one on top of the other and side by side in an at least approximately grain-parallel arrangement and are thus compiled into a long timber pack of specific cross section. The base of the timber feed channel 1 is a cyclically driven slat conveyor 7, after whose front diversion there is disposed a timber push-off plate 8, which is firmly connected to the side walls 9 of the timber feed channel 1 and is designed to prevent jammings of the timbers 6 in the area of the diversion of the slat conveyor 7.

The cut-off device 2 disposed after the timber feed channel 1 comprises, in the represented illustrative embodiment, an upper saw 10 which works from the bottom up. on both sides of the sawing plane 12 formed by the cut-off device 2 there are provided pressure mechanisms 14, 15, which exert perpendicular compression forces upon the long timber pack. These are stationary and exhibit toothed porcupine rollers 16 which can be individually actuated on a pressure-dependent basis. These pressure mechanisms 14, 15, operating as timber press-down elements, can in principle be identically configured, provided that pressure mechanism 15 which is disposed after the sawing plane 12 is able to be directed out of the timber advancement.

The short timber pack conveyor 3 exhibits a base formed by a cyclically driven slat conveyor 17 and, in the represented illustrative embodiment, has a length corresponding to twice the length of a short timber pack 13. The side walls of the chipping conveyor 4 adjoining the last section of the short timber pack conveyor 3 are formed by driven, toothed rollers 18, of which at least those rollers situated at the front in the direction of conveyance are subject to a rapid advancement. Where all rollers 18 have a common drive, an overriding (freewheel) clutch is provided in the drive. The chipping conveyor 4 further exhibits a swivel flap 20 which, in the closed position, covers the conveying cross section of the chipping conveyor and is aligned with the adjacent side wall 19 of the short timber pack conveyor 3, and which, after being released from its closed position, is pivotable about an upper horizontal swivel axis.

In order to remove the short timber packs 13 from the short timber pack conveyor 3 onto the chipping conveyor 4, a kicker arm 21 is provided. For time reasons, however, a supportingly configured change of direction for the short timber packs 13 can be more expedient.

Figure 2:
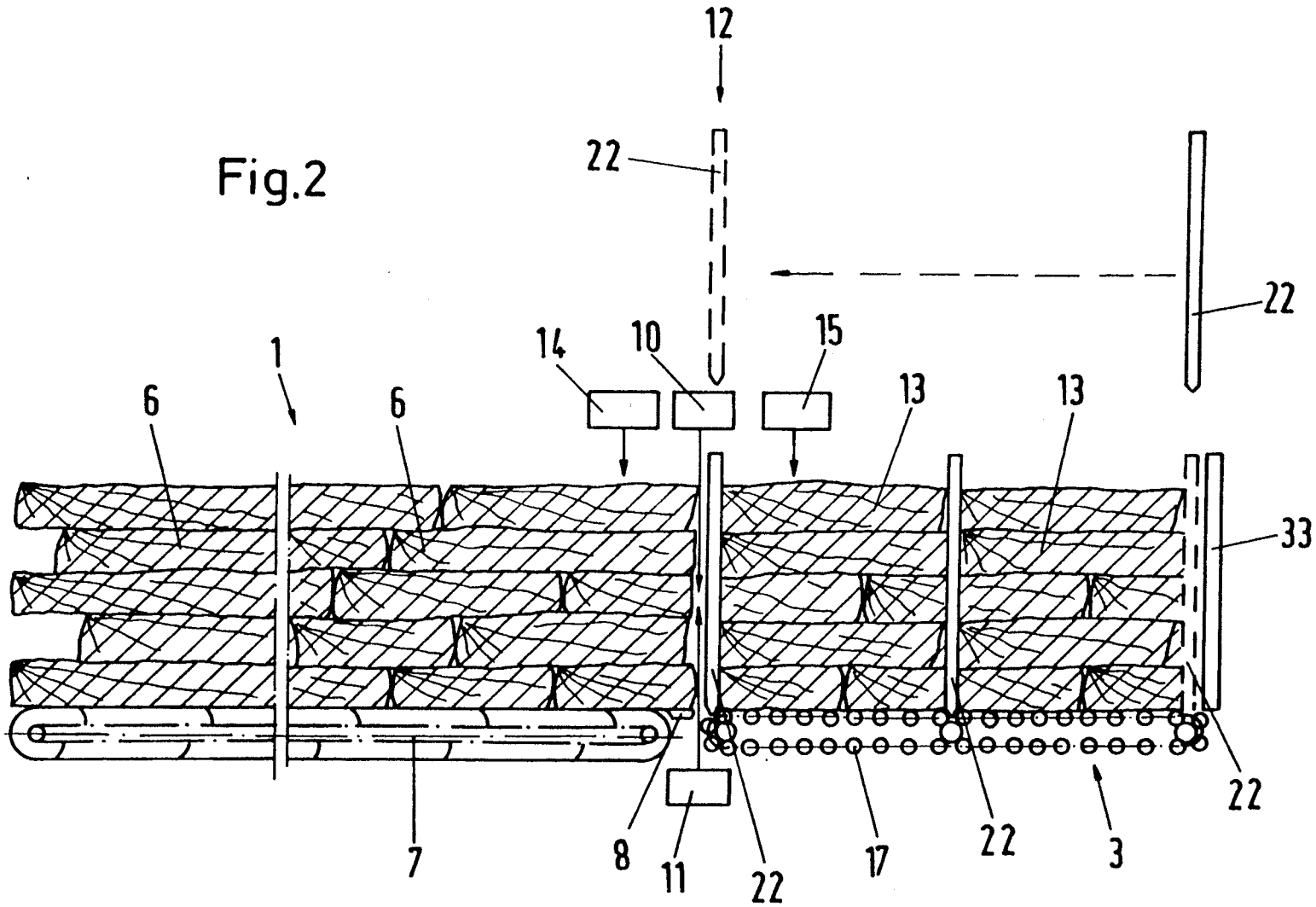
FIG. 2 shows the plant according to FIG. 1 in side view.
Figure 4:
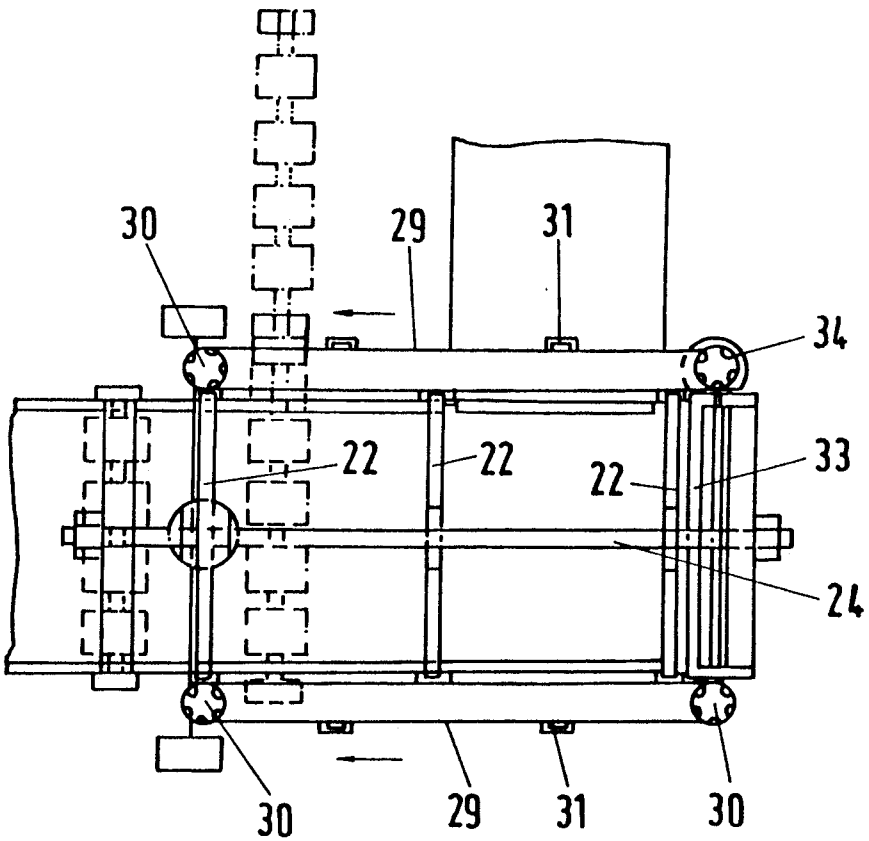
FIG. 4 shows the return conveyor according to FIG. 3 in top view.
Figure 3:
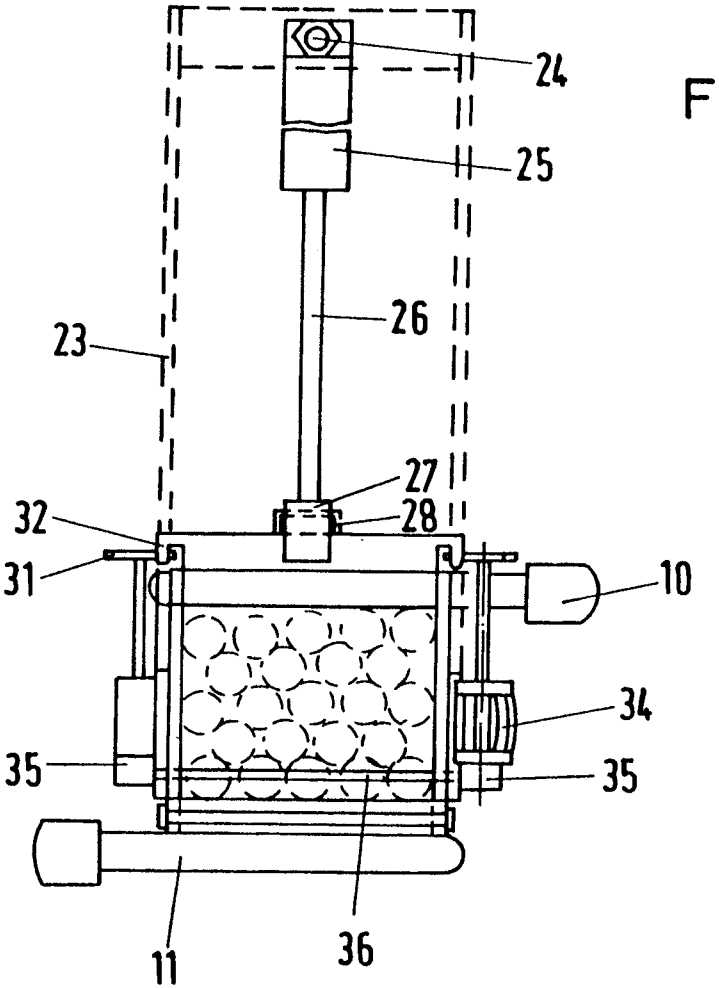
FIG. 3 shows a return conveyor in front view.

FIGS. 3 and 4 show a return conveyor for supporting plates 22. FIG. 2 illustrates that, in the area of the sawing plane 12, a supporting plate 22 is directed in between the leading end face of the long timber pack and the posterior end face of the adjoining short timber pack 13 and is inserted, having its lower longitudinal border in the longitudinal slots, between two plates of the slat conveyor 17. Upon each cyclical advancement, this supporting plate 22 is jointly advanced and supports, at the same time, the two above-mentioned pack end faces. The supporting plate 22 which has reached, in this way, the end of the short timber pack conveyor 3, is taken up by the return conveyor and conveyed back into the area of the sawing plane 12. In the illustrative embodiment, a vertical directing-in and directing-out of the supporting plates 22 and a horizontal return transportation of the supporting plates 22 is provided. For the vertical movement of the supporting plates 22, a horizontal linear drive system 24 in the form of a toothed rack or the like is disposed on a bearing structure 23. The drive system allows horizontal displaceability of a reversing cylinder 25 with piston 26, which opens out into a clamping device 27. The latter embraces an upper clamping collar 28, with which each supporting plate 22 is equipped.

For the horizontal movement in the return guidance of the supporting plates 22, two conveyor chains 29 are provided which circulate on both sides of the side walls 19 and are diverted around chain wheels 30. The conveyor chains 29 are fitted with drivers 31, which can be locked in place by means of driver clamps 32 provided on the supporting plates 22. This locking is effected as soon as a supporting plate 22 has been transported into place in the area of the sawing plane 12; unlocking is effected as soon as the supporting plate 22 has reached a stationary end wall 33 of the short timber pack conveyor 3. The drive of the two conveyor chains 29 is effected by means of a motor 34 and two miter gears 35, which are interconnected by a connecting shaft 36.

Due to the vertical directing-in and directing out of the supporting plates 22, the return conveyor for the supporting plates 22 occupies only a small amount of space in the base. If, based on local conditions, insufficient space is available in the vertical direction, then the supporting plates 22 can also be directed in and out horizontally. The supporting plate 22 which has reached the end wall 33 could then be guided out horizontally through a slot provided in the side wall 19 and guided, at right angles thereto, back into the insertion position in the area of the sawing plane 12.

The inventive plant operates as follows:

When the saw 10 is open, the timber pack 6 is conveyed forward by the slat conveyor 7, by one advancement cycle, past the cut-off device 2, this cyclical advancement distance corresponding in each case to the length of the then sawn-off short timber pack 13 and hence also to the usable chipping length of the chipping tool 5. In this advancement, the leading end face of the timber pack 6 and also, at the same time, the posterior end face of the previously sawn-off short timber pack 13, are supported by a supporting plate 22, which has been transported into place, so that, where appropriate, small timber sections of the butt end slices, lying in front of the forward-traveling timber pack 6, cannot come to rest transversely or tilt forward. Following completion of the advancement, the pressure mechanisms 14, 15 are activated, which exert perpendicular compression forces from above onto the upper layer of the timbers and thus secure them during the sawing cut. The saw 10 now saws through the timber pack 6. While the pressure mechanism 14 disposed upstream of the cut-off device 2 continues to pressurize the timber pack 6, in the case of the downstream pressure mechanism 15, the contact pressure is lowered somewhat to enable the sawn-off short timber pack 13 to be conveyed forward by a few centimeters from the saws 10, 11. Because small pieces of timber are then able to fall into the gap, they are blown out with compressed air. Next, a supporting plate 22 located in the waiting position is then transported into the sawing gap and locked, by means of their driver clamps 32, to the drivers 31 provided on the conveyor chains 29. The sawn-off short timber pack 13 is now enclosed on five sides: on the longitudinal sides by the side walls 19, on the two end faces by the two supporting plates 22 and on the underside by the circulating roller chain 17.

The two pressure mechanisms 14, 15 and the saw 10 then travel back into the home position. A further advancement cycle of the long timber pack is effected. While or before the pressure mechanisms 14, 15 and the saw 10 resume their work, the kicker arm 21 forces the short timber pack 13 lying in front of it onto the chipping conveyor 4, namely by a distance of travel corresponding to the width of the short timber pack conveyor 3. As a result, the removed short timber pack 13 pushes the previously unlocked swivel flap 20 gradually upwards, which swivel flap releases the short timber pack 13 as soon as it has been taken up on both sides by the toothed rollers 18, which convey the short timber pack 13 forward in rapid advancement until it bears against the rear side of the short timber packs 13 accumulating in front of the chipping tool 5.

That supporting plate 22 which, upon each advancement cycle, finishes up in contact with the end wall 33 of the short timber pack conveyor 3, is taken up by the return conveyor in the above-described manner and transported back into a waiting position in the area of the sawing plane 12.

In principle, it is not necessary, after the saw-off cut has been carried out, to create, by slight forward conveyance of the just sawn-off short timber pack 13, a suff iciently large sawing gap to receive a supporting plate 22. It is thus possible, for example, to transport a supporting element directly behind the leading sawing tool, synchronously with this, into the sawing cut. In this instance, the width of cut of the saw must measure approximately 20 mm, the thickness of the supporting plate 22 approximately 18 mm. Around 2% of fine material is obtained in this case, which can be supplied to the boilerhouse for combustion.

In order to achieve very short cycle times combined with a suitable level of performance, the saw 10, configured as a chain saw, can also be mounted pivotably by 360° about a center of rotation. In this case, the saw 10 should simultaneously be disposed such that it can be displaced vertically by the maximum height of the timber pack 13. The saw 10, which in this case saws through from top to bottom, is directly tracked by the supporting plate 22.

In order to be able to perform a continuous chipping for strands of timbers, a short timber pack 13 must be made available approximately every 20 seconds. In this case, a structural distortion-free transportation of the short timber pack 13 into the chipping area must be guaranteed. The logs which are compiled in the pack must not roll against one another; small pieces must not come to rest transversely in cavities. Each single piece of timber must remain fixed in the position which it occupied when the short timber pack 13 was sawn off. With regard to time savings, it is essential that, synchronously with the cyclical advancement of the long timber pack, the previously sawn-off short timber pack 13 can also at the same time be supportingly conveyed forward, thereby avoiding dead times. In order additionally to avoid any dead time, in respect of the forward conveyance, which may be caused by the kicker arm 21, the kicker arm can be replaced by a downward-rolling change of direction. Or, indeed, provision can be made f or the kicker arm 21 to be active only during the sawing operation and, following the conclusion of the sawing operation, to return to its home position.

While the invention has been described with reference to certain preferred embodiments, numerous alterations and modifications to the described embodiments are possible without departing from the spirit and scope of the invention, as def ined by the appended claims and equivalents thereof.

What is claimed is:

1. A process for the continuous chipping of timbers of different lengths and shapes, comprising the steps of:

piling the timbers in essentially longitudinal alignment one on top of the other and side by side in an at least approximately grain-parallel arrangement to form a long timber pack;

advancing the long timber pack, in cycles, in the longitudinal direction;

compressing the long timber pack with perpendicular compression forces on both sides of a sawing plane;

cross-cutting after each advancement cycle by a pack length corresponding to an advancement distance and to a usable chipping length to form equal-length short timber packs;

inserting at least one supporting element for supporting a leading end face of the long timber pack and a posterior end face of a just sawn-off short timber pack into the sawing plane;then conveying the long timber pack, together with the just sawn-off short timber pack and the supporting element enclosed between them, forward by one advancement cycle in the same direction;

returning a second supporting element to an insertion area of the sawing plane;

supporting the short timber packs, at least on their undersides and two end sides;

conveying the short timber packs thus formed in continuous succession transversely to their grain alignment; and chipping the short timber packs parallel to the grain.

2. The process as claimed in claim 1, further comprising the step of preliminarily supporting the leading end face of the long timber pack and the posterior end face of the just sawn-off short timber pack with a tool used for the cross-cutting step.

3. The process as claimed in claim 1, wherein the inserting step further comprises the step of synchronously transporting the supporting element directly behind a sawing tool into the sawing cut.

4. The process as claimed in claim 1, further comprising, after the cross-cutting step, the step of conveying the just sawn-off short timber pack slightly forward in the direction of advancement of the long timber pack to create a gap for inserting the supporting element.

5. The process as claimed in claim 1, wherein the cross-cutting step includes the step of cross-cutting from a bottom of the long timber pack upwards.

6. The process as claimed in claim 1, wherein the inserting step includes the step of inserting a lower longitudinal border of the supporting element between plate sections of a conveyor.

7. A device for the continuous chipping of timbers of different lengths and shapes,comprising:

a timber feed channel for receiving long timbers piled essentially in longitudinal alignment one on top of the other and side by side in an at least approximately grain-parallel arrangement and thereby compiled into a long timber pack;

advancement elements for the cyclical advancement of the long timber pack;

a cut-off device;

pressure mechanisms disposed on both sides of a sawing plane for exerting perpendicular compression forces on the long timber pack;

a chipping conveyor, a width of which corresponds to a length of a short timber pack or to a usable length of a chipping tool and which supports short timber packs, at least on their undersides and their two end sides, and, transversely to their grain direction, feeds a chipping tool for grain-parallel chipping;

a short timber pack conveyor located upstream from the chipping conveyor and aligned with the timber feed channel and having a length of at least twice the short timber pack length;

supporting plates for insertion between leading end faces of long timber packs and posterior end faces of adjoining short timber packs; and a return conveyor for taking up the supporting plates which have arrived at an end of the short timber pack conveyor and conveying them back into an area of the sawing plane.

8. The device as claimed in claim 7, wherein the timber feed channel further comprises a base configured as a cyclically driven slat conveyor.

9. The device as claimed in claim 8, further comprising a timber push-off plate disposed directly after a front diversion of the slat conveyor.

10. The device as claimed in claim 7, wherein the pressure mechanisms provided on both sides of the sawing plane include toothed porcupine rollers disposed in stationary positions and individually actuated on a pressure-dependent basis.

11. The device as claimed in claim 7, wherein a pressure mechanism disposed downstream of the sawing plane can be directed out of the way of timber advancement.

12. The device as claimed in claim 7, wherein the cut-off device comprises a saw which cuts from the bottom upwards.

13. The device as claimed in claim 12, wherein the cut-off device includes a chain saw with a wide cutter bar which constitutes a provisional end wall support.

14. The device as claimed in claim 7, wherein the short timber pack conveyor further comprises a base including a cyclically driven slat conveyor and wherein each supporting plate is inserted at its lower longitudinal border between two plate sections.

15. The device as claimed in claim 7, wherein the supporting plates include, on their top edges, driver clamps, which correspond to drivers located on the return conveyor.

16. The device as claimed in claim 7, wherein the chipping conveyor adjoins the short timber pack conveyor at right angles and includes a swivel flap which covers the conveying cross section of the chipping conveyor and is aligned with an adjacent side wall of the short timber pack conveyor, and which is pivotable about an upper horizontal swivel axis and lockable in a closed position.

17. The device as claimed in claim 7, wherein the chipping conveyor further comprises side walls formed by vertically disposed chain strands.

18. The device as claimed in claim 7, wherein the chipping conveyor further comprises side walls formed by toothed rollers.

* * * * *